United States Patent [19]

Kostylev et al.

[11] 4,369,002

[45] Jan. 18, 1983

[54] METHOD OF EMPTYING PIPES DRIVEN INTO EARTH IN NONTRENCH LAYING AND DEVICE FOR CARRYING SAME INTO EFFECT

[76] Inventors: Alexandr D. Kostylev, ulitsa Derzhavina, 19, kv. 44.; Vladimir P. Gileta, ulitsa Bolshevistskaya, 175/3, kv. 68.; Vladimir A. Grigoraschenko, ulitsa Kamenskaya, 82, kv. 51.; Khaim B. Tkach, ulitsa Frunze, 67, kv. 272.; Valery A. Kozlov, ulitsa O. Dundicha, 3, kv. 204.; Anatoly V. Sukhushin, ulitsa Michurina, 21-a, kv. 9., all of Novosibirsk; Vladimir A. Bakunin, ulitsa Chkalova, 96, kv.5.; Mikhall J. Bondar, ulitsa Zhukovskogo, 22-a, kv. 4., both of Odessa, all of U.S.S.R.

[21] Appl. No.: 228,277

[22] Filed: Jan. 26, 1981

[51] Int. Cl.[3] ..... E02D 29/10

[52] U.S. Cl. ..... 405/184; 175/405; 405/138

[58] Field of Search ..... 405/84, 146, 141, 138, 405/139, 145; 175/308, 62, 405, 53, 92; 166/99

[56] References Cited

U.S. PATENT DOCUMENTS

| | | | |
|---|---|---|---|
| 675,355 | 5/1901 | MacHarg | 405/145 X |
| 1,948,733 | 2/1934 | Robertson | 405/184 X |
| 3,005,314 | 10/1961 | Cunningham | 405/138 X |
| 3,356,167 | 12/1967 | Trent | 405/184 X |
| 3,472,036 | 10/1969 | Khodosh et al. | 405/141 |
| 3,656,563 | 4/1972 | Blinne | 175/53 X |

FOREIGN PATENT DOCUMENTS

| | | | |
|---|---|---|---|
| 960062 | 12/1974 | Canada | 175/308 |
| 1434680 | 5/1976 | United Kingdom | 175/308 |

*Primary Examiner*—Dennis L. Taylor

*Attorney, Agent, or Firm*—Lilling & Greenspan

[57] ABSTRACT

A method of emptying pipes driven into earth in nontrench laying is disclosed, wherein spoil is dug and picked up in the process of movement of a working element by vibratory shock loads, a spoil cushion is simultaneously formed in the pipe for the purpose of taking up reaction loads set up by the movement of the working element, the direction of the vibratory shock loads is reversed after a spoil load is picked up, and the spoil cushion is removed upon completion of the pipe emptying cycles. A device for carrying this method into effect comprises a working element which has a means for retaining the spoil load during withdrawal thereof and is constructed as a barrel, the blind end of which is rigidly connected with a reversible pneumatic hammer, and a chamfer being provided on the open end of the barrel, on the outer surface thereof nearest to the pipe bottom. The angle of the chamfer to the pipe bottom is chosen so as to enable the barrel to form, during the movement thereof, the spoil cushion for the purpose of taking up reaction loads set up by the barrel movement.

3 Claims, 3 Drawing Figures

METHOD OF EMPTYING PIPES DRIVEN INTO EARTH IN NONTRENCH LAYING AND DEVICE FOR CARRYING SAME INTO EFFECT

FIELD OF THE INVENTION

This invention relates to methods of and means for laying underground pipelines and has particular reference to a method of emptying pipes driven into earth in non-trench laying and a device for carrying this method into effect.

The invention may be used with advantage for emptying out spoil from pipes driven into earth as well as for cleaning out pipelines in service. It may be useful, in particular, in pipe sections 30 to 40 m long, 300 to 1,400 mm in diameter, used as conduits for electric power and telephone cables or water supply and sewer lines.

BACKGROUND ART

Known in the art are methods of and means for emptying pipes driven into earth in nontrench laying which are based upon cyclic digging, picking-up and removal of spoil from a pipe by means of scoops, barrels, special conveyors, hydraulic monitors or by hand (see, for example, Lavrov G. E. Modern Methods of Constructing Underground Crossings, GosINTI, 1960; Lavrov G. E., Construction of Underground Pipeline Crossings, VNIIST Glavgaza U.S.S.R., 1961).

The forementioned methods and means of the prior art suffer from the disadvantage that they involve a large amount of auxiliary work before and after the pipe emptying job, high percentage of manual labour, and cumbersome equipment.

Also known in the art as a method of emptying pipes driven into earth in nontrench laying which is based upon spoil digging, picking-up and removal operations performed in cycles as the pipe involved is driven into earth.

The device for carrying this method into effect comprises a working element adapted to dig, pick up and remove spoil and provided with a means for retaining the spoil load during withdrawal thereof and further comprises a mechanism designed for moving the working element and kinematically connected therewith.

The working element of this device operates on the principle of a backshovel and comprises a frame which mounts a scoop with a cutting edge and an apron.

The mechanism for moving the working element is constructed as a winch kinematically connected with the parts of the working element through a system of ropes and guide pulleys (see, for example, the Builder's Handbook on Construction of Urban Gas Supply Systems, Moscow, Stroiizdat, 1976, pages 288–290).

Pulling the ropes moves the scoop up and down so that the scoop cutting edge digs spoil, the apron being filled with the material.

After the apron is filled up, the working element is withdrawn from the pipe by means of the winch, the apron is emptied out, the pipe is driven further into earth and the cycle is repeated.

Inasmuch as the outer surface of the scoop makes contact with the inner surface of the pipe, the working element of the device under consideration is applicable only to one pipe diameter.

The working element constructed as a scoop with a cutting edge and an apron cannot be used for emptying the entire length of a pipe already driven into earth and therefore the pipe has to be driven a short distance after each emptying cycle, which complicates and lengthens the emptying process and, consequently, reduces the rate of work.

Furthermore, the emptying process is lengthened due to slow digging, picking-up and removal of spoil, since inserting the working element into the pipe, moving the scoop to the spoil, digging the spoil, loading, removing the apron with the spoil load from the pipe, and discharging the spoil load from the apron are all separate operations causing waste of time.

The cumbersome construction of the working element and its moving mechanism and the complicated kinematic connection therebetween make it impossible to use said device where maneuverability is required for emptying several pipes in succession.

SUMMARY OF THE INVENTION

It is an object of the present invention to provide a method of emptying pipes driven into earth in nontrench laying, whereby pipes of various diameters can be handled.

It is another object of the present invention to provide a method of emptying pipes, whereby the working element is operated by a motive force in a more efficient manner.

It is still another object of the present invention to provide a highly efficient method of emptying pipes and a device for carrying the same into effect.

It is still another object of the present invention to simplify the construction of main moving mechanisms of the device for carrying said method into effect.

It is still another object of the present invention to provide a maneuverable device for carrying said method into effect.

These objects are achieved by a method of emptying pipes driven into earth in nontrench laying, wherein spoil is cyclically dug, picked up and removed from a pipe by means of a working element, the digging and picking-up of spoil is performed as the working element moves along the pipe by vibratory shock loads, a spoil cushion is simultaneously formed in the pipe for the purpose of taking up reaction loads set up by the movement of the working element, the direction of the vibratory shock loads is reversed after a spoil load is picked up, and the spoil cushion is removed upon, completion of the pipe emptying cycles.

These objects are also achieved in a device for carrying this method into effect, wherein the working element designed for digging, picking up and removing spoil is provided with a means for retaining the spoil load during withdrawal thereof and is kinematically connected with a mechanism for moving the working element. The mechanism is constructed as a reversible pneumatic hammer, working element is constructed as a barrel, the blind end of which is rigidly connected with the pneumatic hammer, and the open end of the barrel is provided with a chamfer on the outer surface thereof nearest to the bottom of the pipe, the angle of the chamfer to the bottom of the pipe being chosen so as to enable the barrel to form, during the movement thereof, a spoil cushion for the purpose of taking up reaction loads set up by the barrel movement.

It is desirable that the angle of the chamfer to the bottom of the pipe be within 5° to 45°.

BRIEF DESCRIPTION OF THE DRAWINGS

The invention will now be more particularly described by way of example with reference to the accompanying drawings, wherein.

DETAILED DESCRIPTION OF THE INVENTION

Figure 1:
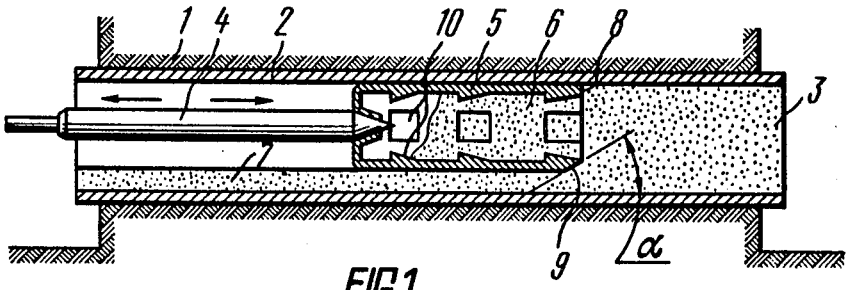
FIG. 1 is a sectional view taken along the axis of a pipe driven into earth in nontrench laying and showing the pipe emptying device according to the invention.

The method for emptying pipes driven into earth in nontrench laying is as follows:

A pipe 2 (FIG. 1) is driven into earth 1 by means of a pneumatic hammer, due to which the pipe 2 is filled with spoil 3.

The method is based upon cyclic digging, picking-up and removal of the spoil 3 by means of a working element.

The vibratory shock loads produced by the pneumatic hammer 4 move the working element which is constructed as a barrel 5. In moving along the pipe 2, the barrel 5 digs the spoil and picks up a spoil load 6, and at the same time forms in the pipe 2 a spoil cushion 7 for the purpose of taking up reaction loads set up by the barrel movement.

After the spoil load 6 is picked up by the barrel 5, the direction of the vibratory shock loads is reversed, whereby the barrel 5 with the spoil load 6 is moved out of the pipe 2.

Upon completion of all the pipe emptying cycles, the spoil cushion 7 is removed.

The device for carrying this method into effect comprises the pneumatic hammer 4, which is reversible and is rigidly connected to the blind end of the barrel 5.

Figure 2:
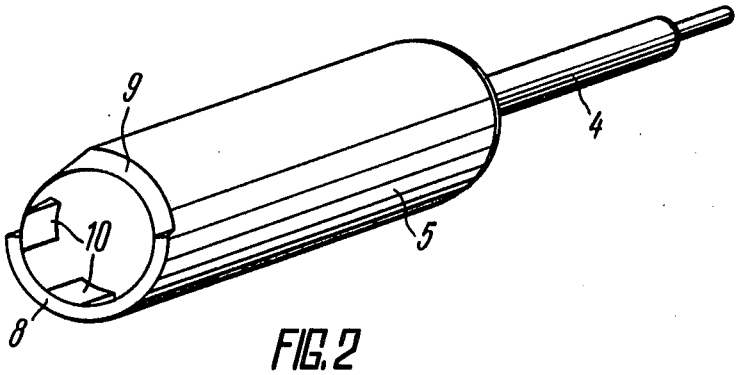
FIG. 2 is an axonometric view of the same device according to the invention.

A chamfer 9 (FIG. 2) is provided on the open end 8 of the barrel 5, on the outer surface thereof nearest to the bottom of the pipe 2.

An angle $\alpha$ (FIG. 1) which the chamfer 9 makes with the bottom of the pipe 2 is to be chosen so as to enable the barrel 5 to form, during the movement thereof, the spoil cushion 7 for the purpose of taking up reaction loads set by the barrel movement.

It is advantageous that this angle $\alpha$ be within 5° to 45°.

During reverse movement of the barrel 5 in the pipe the spoil load 6 is held in place by retainers 10 which are rigidly mounted inside the barrel 5 and are shaped as a frustum of a cone whose small diameter faces toward the open end 8.

The retainers 10 mounted inside the barrel 5 are spaced apart along the barrel and around the circumference thereof.

The device operates as follows:

The spoil load 6 fills the barrel 5 as it digs into the spoil. During the movement of the barrel 5 the chamfer 9 permits formation of the spoil cushion 7. The adhesion of the barrel 5 to the pipe 2 is effected through the spoil cushion 7. This makes it possible to increase the speed of movement of the barrel 5 in the pipe 2, inasmuch as an increase in the recoil force produced by the operation of the pneumatic hammer 4 is compensated for by an increase of the adhesion force.

After the filling of the barrel 5 with the spoil load 6 is completed, the pneumatic hammer 4 is reversed, whereby the barrel 5 is moved back in the pipe 2.

After the barrel 5 comes out of the pipe 2, the spoil load 6 is discharged therefrom and the cycle is repeated. The number of the cycles in which the spoil is dug, picked up and removed depends on the length of the pipe 2 being emptied.

Figure 3:
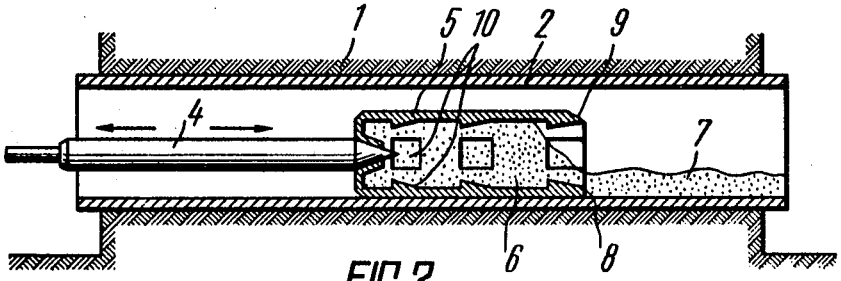
FIG. 3 is a sectional view taken along the axis of a pipe driven into earth in nontrench laying and depicting the operation of removing the soil cushion upon completion of the pipe emptying cycles.

Before the last run the barrel 5 is turned about its longitudinal axis and installed in the pipe 2 (FIG. 3) so that the chamfer 9 is away from the spoil cushion 7. This provides for removing the spoil cushion 7 and emptying the pipe 2 completely.

During the last run of the barrel 5 the pneumatic hammer 4 operates at a reduced pressure and this cycle is performed at a lower speed, which, however, does not affect the working capacity of the device on the whole.

Since the barrel 5 is provided with the chamfer 9 which enables forming the spoil cushion 7, the device can be used for emptying out spoil from pipes of various diameters and can also be used for cleaning out pipes in service.

What is claimed is:

1. A method of emptying pipes driven into earth in nontrench laying, which method is based on cyclic digging, picking up and removing spoil from a pipe and comprises the steps of:

digging soil in said pipe by means of a working element in the process of movement thereof along said pipe by vibratory shock loads;

picking up spoil in the process of movement of said working element along said pipe by vibratory shock loads;

forming a spoil cushion, simultaneously with digging and picking up spoil, for taking up reaction loads set up by the movement of said working element;

withdrawing a spoil load, after it is picked up, from said pipe by reversing the direction of vibratory shock loads; and removing said spoil cushion upon completion of pipe emptying cycles.

2. A device for emptying pipes driven into earth in nontrench laying, comprising:

a working element for digging, picking up and removing spoil and constructed as a barrel having an open end and a blind end;

a means for retaining the spoil load during withdrawal thereof, said means being provided in said barrel;

a mechanism for moving the working element and constructed as a reversible pneumatic hammer rigidly connected with the blind end of the barrel;

a chamfer provided on the open end of said barrel on the outer surface thereof nearest to the bottom of said pipe, the angle of the chamfer to the pipe bottom being chosen so as to enable the barrel to form, during the movement thereof, a spoil cushion for taking up reaction loads set up by the barrel movement.

3. A device as claimed in claim 2, wherein the angle of said chamfer to the pipe bottom is within 5° to 45°.

* * * * *